United States Patent [19]

Davey

[11] Patent Number: 4,728,003

[45] Date of Patent: Mar. 1, 1988

[54] REMOVABLE RETAINING DEVICE FOR A CONTAINER LID

[76] Inventor: Kenneth G. Davey, 12 Brantwood Road, Herne Hill, London SE240D5, England

[21] Appl. No.: 49,115

[22] Filed: May 13, 1987

[30] Foreign Application Priority Data

May 22, 1986 [GB] United Kingdom ..... 8612445

[51] Int. Cl.[4] ..... B65D 45/32

[52] U.S. Cl. ..... 220/319; 220/354; 220/306

[58] Field of Search ..... 220/319, 306, 354; 206/821

[56] References Cited

U.S. PATENT DOCUMENTS

| | | | |
|---|---|---|---|
| 4,111,330 | 9/1978 | Jordan | 220/306 |
| 4,298,134 | 11/1981 | Lewis, Jr. | 220/354 |
| 4,344,546 | 8/1982 | Dry | 220/319 |
| 4,625,890 | 12/1986 | Gaher | 220/319 |

*Primary Examiner*—George T. Hall

*Attorney, Agent, or Firm*—Fisher, Christen & Sabol

[57] ABSTRACT

A removable retaining device is provided for a container lid (1, 1*a*), having a continuous strengthening recess (2) therearound in its outer surface (3) adjacent its rim (4), and being a press fit in a corresponding aperture in a container (5) such as a paint can, which device is a continuous ring-like member (10) made of springy substantially rigid material having a substantially U-shaped cross-section, of which the innermost limb (11) is continuous or substantially continuous and the outermost limb (12) is interrupted at intervals to provide a plurality of spaced apart fingers (13) extending from the base (14) of the member (10) spaced from and substantially parallel to the innermost limb (11), with each finger (13) having a tooth-like projection (15) extending therefrom, at or adjacent its outermost end (16), towards the innermost limb (11), so that with the lid (1, 1*a*) fitted in the container aperture the member (10) can be fitted thereover with the innermost limb (11) projecting into and at least substantially filling the lid strengthening recess (2) to strengthen the container (5), with the base (14) fitting over the lid rim (4) and container rim (7) to provide further cushioning and protection for the lid and container rims (4,7) against a blow on the container rim (7), and with the outermost limb fingers (13) fitting around the container exterior with the tooth-like projections (15) releasably clipping under the container rim (7) removably to retain the member (10) on the interfitting lid and container end to provide a retaining action on the lid (1, 1*a*) against internal pressure on the lid (1, 1*a*) due, for example, to a blow on the container base, tending to force the lid (1, 1*a*) out of the container aperture and off the container (5).

4 Claims, 4 Drawing Figures

REMOVABLE RETAINING DEVICE FOR A CONTAINER LID

FIELD OF THE INVENTION

This invention relates to a removable retaining device for a container lid particularly suitable for a container such as a paint can having a lever-off panel lid. Such a container lid generally has a continuous strenthening recess therearound in its outer surface adjacent its rim and is a press fit in a corresponding aperture in the container.

BACKGROUND OF THE INVENTION AND PRIOR ART

Retaining devices for a paint can lid are known in the form of small clips of metal which clip over the rim of an interfitting lid and container so that one arm of the clip engages one wall of the lid recess and the other arm of the clip engages over the outside of the container rim. Such clips, whilst providing a certain degree of retention for the container lid only do so at the point of application and as usually only two such clips are utilised at diametrically opposed positions on the container lid, the degree of retention provided is limited. Additionally such known clips do not provide any protection against a blow on the container end adjacent the lid rim which blow can readily buckle the container wall, container rim and lid rim in the region of the lid recess with consequent forcing of the lid out of the container. Similarly such known clips do not provide any really effective retaining force against a blow on the base of the container tending to force the lid upwardly out of the container.

OBJECTS OF THE INVENTION

With increasing stringency in requirements for safety in carrying inflammable or toxic materials in containers, such as paint in cans, it is increasingly more desirable to provide improved means for retaining the lid on a container and it is an object of the invention to do this.

It is another object of the invention to provide a removable lid retaining device with improved resistance to impacts on the container which would otherwise tend to force the lid out of the container and permit the contents thereof to escape.

SUMMARY OF THE INVENTION

According to the present invention there is provided a removable retaining device for a container lid having a continuous strengthening recess therearound in its outer surface adjacent its rim, and being a press fit in a corresponding aperture in a container such as a paint can, which device is a continuous ring-like member made of springy substantially rigid material having a substantially U-shaped cross-section, of which the innermost limb is continuous or substantially continuous and the outermost limb is interrupted at intervals to provide a plurality of spaced apart fingers extending from the base of the member spaced from and substantially parallel to the innermost limb, with each finger having a tooth-like projection extending therefrom, at or adjacent its outermost end, towards the innermost limb, so that with the lid fitted in the container aperture the member can be fitted thereover with the innermost limb projecting into and at least substantially filling the lid strengthening recess to strengthen the lid against collapse due to a blow on the rim of the apertured end of the container, with the base fitting over the lid rim and container rim to provide further cushioning and protection for the lid and container rims against a blow on the container rim, and with the outermost limb fingers fitting around the container exterior with the tooth-like projections releasably clipping under the container rim removably to retain the member on the interfitting lid and container end to provide a retaininng action on the lid against internal pressure on the lid due, for example, to a blow on the container base, tending to force the lid out of the container aperture and off the container.

Preferably the ring-like member is made from turned or moulded plastics material, such as polypropylene.

Advantageously the ring-like member and base thereof are annular in plan, and the innermost limb is continuous and has a width such that it slidably fits into the lid recess in contact with the side walls thereof.

Conveniently the device includes a tear-off tamper resistant strip removably attached to the member around the edge of the outermost limb defined by the tooth-like projection bearing ends of the fingers.

BRIEF DESCRIPTION OF THE DRAWINGS

For a better understanding of the present invention, and to show how the same may be carried into effect, reference will now be made, by way of example, to the accompanying drawings, in which.

DETAILED DESCRIPTION OF THE DRAWINGS

Figure 1:
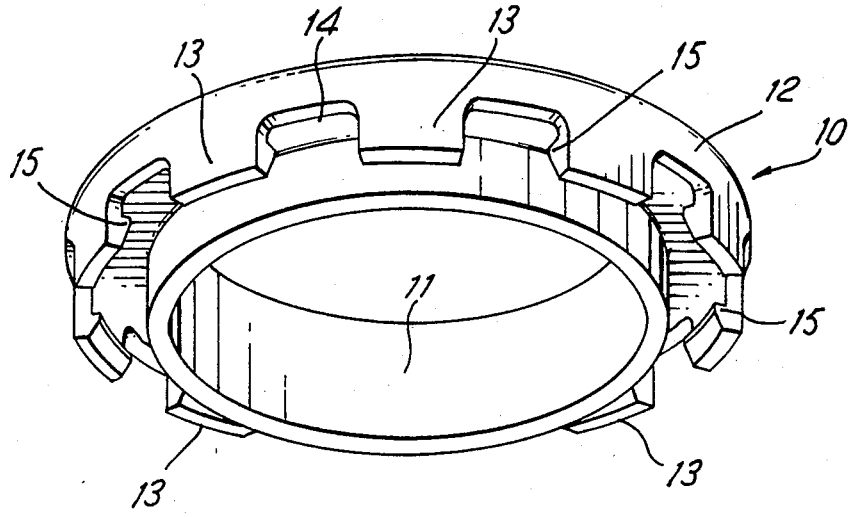
FIG. 1 is a perspective view from below of a removable retaining device according to a first embodiment of the invention.

Although in the accompanying drawings and in the description relating thereto a removable retaining device for a container lid will be described in conjunction with a cylindrical container and a circular lid it is, of course, to be understood, that such a device of the invention could be used with a square, rectangular or other shaped container and lid if necessary, by manufacturing the device with a shape conforming to that of the lid and container with which it is to be used.

As shown in the accompanying drawings a removable retaining device of the invention is intended for use with a container lid 1 or 1*a* having a continuous strengthening recess 2 therearound in its outer surface 3 adjacent its rim 4. The lid 1, 1*a* is a press fit in a corresponding aperture in a container 5 such as a paint can. In the example illustrated in FIG. 3 of the accompanying drawings the aperture in the paint can 5 is provided by an annular recess 6 formed around the top end of the can 5 between its rim 7 and the central aperture of the can defined by its innermost rim 8. In this instance the lid which is generally pressed from thin metallic sheet to provide a raised central panel 3*a* fits into the container 5 by engagement of its portion defining the recess 2 into the correspondingly shaped annular recess 6 in the container 5. The lid rim 4 abuts the container end portion between the container rim 7 and annular recess 6 with sufficient space being left between the rim 7 and rim 4 for the insertion of an opening means, such as a screw driver blade, below the rim 4 to enable the lid to be levered away from the container 5.

Figure 4:
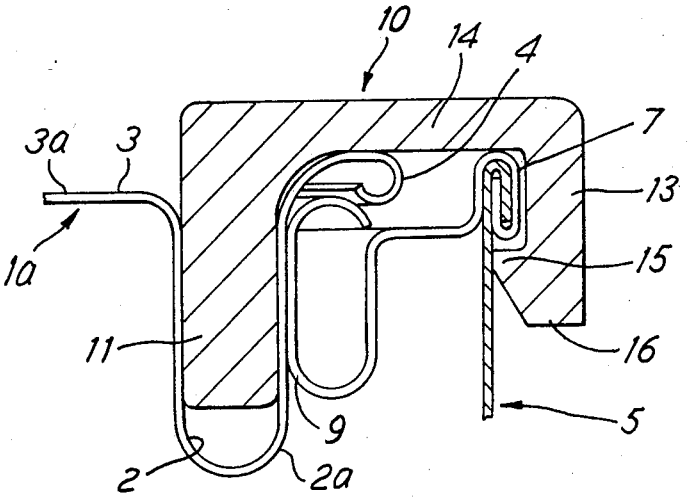
FIG. 4 is a detailed view similar of that of FIG. 3, showning a cross-sectional view through a greater width device than that of FIG. 3 in operative association with a different type of interfitting lid and container end.

In the alternative form of lid and container construction shown in FIG. 4 the lid 1*a* is also of raised panel construction pressed from a sheet of metallic material but in this case the central aperture of the container 5 is defined by an inner rim portion 9 into which the lid 1*a* fits by sliding engagement between the outermost wall 2*a* of the lid portion defining the recess 2 with the lid rim 4 similarly engaging the container end between its inner rim portion 9 and its outer rim 7.

The removable retaining device of the invention for retaining the lid 1 or 1*a* in the container 5 is a continuous ring-like member 10 made of springy, substantially rigid material. The member 10 can be made from any suitable material in any suitable manner but preferably is made from plastics material such as polypropylene, preferably by turning or moulding therefrom. The member 10 has a substantially U-shaped cross-section as shown more clearly in FIGS. 3 and 4, with an innermost limb 11 which is continuous as illustrated although it could be interrupted in part so as to be substantially continuous if desired. The outermost limb 12 of the member 10 is interrupted at intervals to provide a plurality of spaced-apart fingers 13 extending from the base 14 of the member 10, spaced from and substantially parallel to the innermost limb 11.

Figure 2:
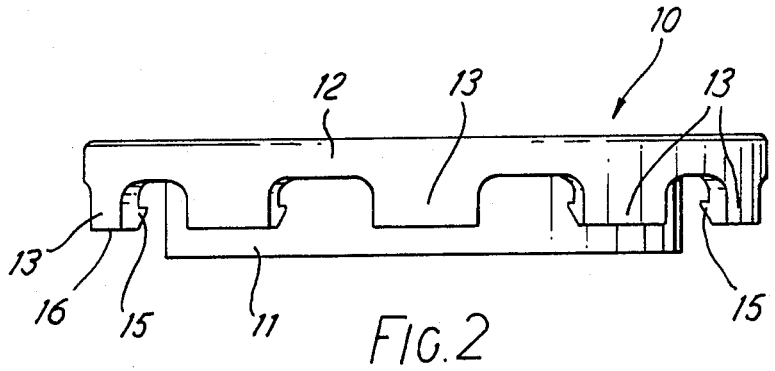
FIG. 2 is a side view of the device of FIG. 1.
Figure 3:
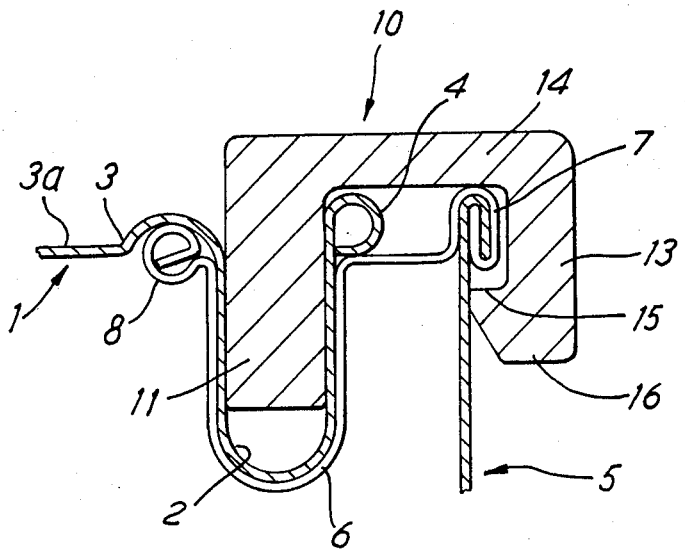
FIG. 3 is a cross-sectional view, to an enlarged scale, through a device of FIGS. 1 and 2 shown in operative association with an interfitting lid and container end.

Each finger 13 has a tooth-like projection 15 extending therefrom, at or adjacent its outermost end 16 towards the innermost limb 11 as can be particularly seen from FIGS. 2, 3 and 4.

As shown in FIGS. 3 and 4 the member 10 has a width such that it slidably fits into the lid recess 2 in contact with the side walls thereof. To this end the width of the member 10 can be chosen to suit the dimensions of the container and lid with which it is to be used. Thus with the lid 1, 1a fittd into the container aperture the member 10 can be fitted thereover with the innermost limb 11 projecting into and at least substantially filling the lid strengthening recess 2 as shown in FIGS. 3 and 4. To strengthen the lid against collapse due to a blow on the rim 7 of the apertured end of the container. In this position the base 14 of the member 10 fits over the lid rim 4 and container rim 7 to provide further cushioning and protection for the lid and container rims 4 and 7 against a blow on the container rim 7. Similarly in this position, as shown in FIGS. 3 and 4, the outermost limb fingers 13 fit over the container exterior with the tooth-like projections 15 releasably clipping under the container rib 7 by means of their projections 15, removably to retain the member 10 on the interfitting lid and container end. The member 10 thus provides a retaining action on the lid against internal pressure on the lid, due, for example, to a blow on the container base, tending to force the lid out of the container aperture and off the container 5. Thus the ring like member 10 of the invention covers over and protects the lid rim 4 and container rim 7 as well as filling in the lid recess 2 thereby protecting the lid and container rims against deformation from blows thereon, strengthening the lid against damage by such blows and covering over the lid rim 4 against accidental levering off or against any tampering with the contents of the container.

To the latter end the member 10 may be provided with a tear-off tamper resistance strip removably attached to the member around the outermost end 16 of the fingers 13 of the outermost limb 12. To remove the member 10 from an interfitting lid and container end it is merely necessary, after the tamper resistant strip has been removed or in the absence of such strip, to insert a lever like means such as a screw driver blade under the end 16 of one finger 13 between the projection 15 and outer wall of the container 5 initially to lever at least one finger end projection away from the container wall sufficiently for the projection to start to ride up over the container rim 7, then insert the screw drive blade through the interrupted portions of the member between the fingers 13 between the base 14 and upper edge of the outer rim 7 of the container 5 and prise the member 10 away from the container and lid. Of course when the member 10 has been removed from the lid and container end, the lid may be removed from the container in the usual way and when the lid has been replaced on the container the ring-like member 10 can likewise be replaced thereon.

The device of the invention, as can be seen, thus considerably improves the strength and security of a container having a lid of the kind described. Such an improvement in strength, impact resistance and tamper resistance is particularly desirable for containers carrying noxious or toxic materials which are often subject to damage during travelling or loading and unloading from a carrying vehicle, by dropping or other impact, with consequent ejection of the lid and of the dangerous contents thereof.

I claim:

1. A removable retaining device for a container lid having a continuous strengthening recess therearound in its outer surface adjacent its rim, and being a press fit in a corresponding aperture in a container such as a paint can, which device is a continuous ring-like member made of springy substantially rigid material having a substantially U-shaped cross-section, of which the innermost limb is continuous or substantially continuous and the outermost limb is interrupted at intervals to provide a plurality of spaced apart fingers extending from the base of the member spaced from and substantially parallel to the innrmost limb, with each finger having a tooth-like projection extending therefrom, at or adjacent its outermost end, towards the innermost limb, so that with the lid fitted in the container aperture the member can be fitted thereover with the innermost limb projecting into and at least substantially filling the lid strengthening recess to strengthen the container, with the base fitting over the lid rim and container rim to provide further cushioning and protection for the lid and container rims against a blow on the container rim, and with the outermost limb fingers fitting around the container exterior with the tooth-like projections releasably clipping under the container rim removably to retain the member on the interfitting lid and container end to provide a retaining action on the lid against internal pressure on the lid due, for example, to a blow on the container base, tending to force the lid out of the container aperture and off the container.

2. A device according to claim 1, wherein the ring-like member is made from turned or moulded plastics material, such as polypropylene.

3. A device according to claim 2, wherein the ring-like member and base thereof are annular in plan, and wherein the innermost limb is continuous and has a width such that it slidably fits into the lid recess in contact with the side walls thereof.

4. A device according to claim 1, including a tear-off tamper resistant strip removably attached to the member around the edge of the outermost limb defined by the tooth-like projection bearing ends of the fingers.

* * * * *